United States Patent [19]

Streisel

[11] 3,992,137

[45] Nov. 16, 1976

[54] GAS BURNER

[75] Inventor: John A. Streisel, Bourbonnais, Ill.

[73] Assignee: A. O. Smith Corporation, Milwaukee, Wis.

[22] Filed: Feb. 21, 1975

[21] Appl. No.: 551,711

[52] U.S. Cl. ..... 431/278; 431/59; 239/433; 239/554; 239/434

[51] Int. Cl.[2] ..... F23Q 9/00

[58] Field of Search ..... 431/59, 80, 154, 177, 431/278, 285, 343; 239/433, 434

[56] References Cited

UNITED STATES PATENTS

| | | | |
|---|---|---|---|
| 2,609,866 | 9/1952 | Wright | 431/177 |
| 2,638,975 | 5/1953 | Berry | 431/285 |
| 3,324,925 | 6/1967 | McLaren | 239/434 |
| 3,420,613 | 1/1969 | Christophel | 431/59 |

*Primary Examiner*—Carroll B. Dority, Jr.
*Attorney, Agent, or Firm*—Andrus, Sceales, Starke & Sawall

[57] ABSTRACT

A gas burner for a water heater provides a unitary bracket removably connected to a gas supplying tube and supporting both a pilot burner and a main burner. The unitary support bracket includes a U-shaped portion surrounding an air-gas mixing area communicating with a centrally located gas inlet opening of a gas distributing head providing a plurality of spaced gas outlet ports. A base portion of the U-shaped bracket portion is spaced from the gas distributing head and includes a tube receiving opening and a pair of flanges functioning with a pair of corresponding tabs on the tube to provide a releasable bayonet type connection. An extension of the unitary bracket removably mounts the pilot burner assembly so that the flame axis is spaced adjacent to the gas outlet ports of the gas distributing head.

6 Claims, 6 Drawing Figures

GAS BURNER

BACKGROUND OF THE INVENTION

This invention relates to a gas burner which has been found to be highly desirable for use within a gas fired hot water heater.

Gas fired hot water heaters have utilized gas burners within an area located beneath a lower head of a water containing tank defining a combustion chamber. In many hot water heaters, the burner is inserted into the combustion chamber through an opening in the base of the casing or jacket which surrounds the water tank.

One highly desirable gas burner used within a gas fired hot water heater is shown in the U.S. Pat. No. 3,324,925 issued to McLaren on June 13, 1967, and assigned to a common assignee herewith. The gas burner in the U.S. Pat. No. 3,324,925 patent releasably and removably connects a gas distributing head to a gas conducting tube through a bayonet-type connection while a pilot burner sub-assembly is directly and independently connected to the gas conducting tube through a mounting bracket at a position considerably spaced from the gas distributing head.

SUMMARY OF THE INVENTION

The present invention relates to a gas burner which is of simple construction and provides a specially designed assembly for mutually supporting both a gas distributing head and a pilot burner sub-assembly.

The novel supporting structure provides a releasable inter-connection with a gas conducting tube thereby removably supporting both the main gas distributing head and the pilot sub-assembly. The supporting structure is specially designed to retain the pilot burner at an orientation to operatively supply a flame along an axis spaced from the burner head.

The supporting structure is connected to the distributing head to form a unitary unit therewith and includes a mounting portion spaced from the distributing head to define an air-gas mixing area therebetween. An extension of the unitary unit operatively supports the pilot burner in the spaced position. With such construction, the gas conducting tube is removably connected to the mounting portion of the supporting structure to thereby removably support both the pilot burner and the gas distributing head in a simplified and unique construction.

In a preferred construction, a unitary bracket is fixedly connected to the gas distributing head and removably connected to a bracket retaining the pilot burner. The unitary bracket includes a base or mounting portion which is spaced from the distributing head and provides a circular opening which receives the gas supplying tube. A pair of oppositely spaced slots communicate with the circular opening and are located adjacent to a pair of associated spaced tabs extending downwardly at an angle to the horizontal. A pair of spaced projections extend radially from the gas conducting tube and are removably retained by the pair of spaced tabs to complete a releasable bayonet-type connection.

The mounting or base portion of the unitary bracket is connected to the gas distributing head through a pair of spaced leg portions surrounding an air-gas mixing area. In such an arrangement, the gas supplied from the tube through the opening within the mounting or base portion is mixed with air supplied through the open area between the spaced leg portions. In such manner, the combined air-gas mixture is supplied to a centrally located gas inlet opening provided by the gas distributing head.

One of the spaced legs of the unitary bracket member is integrally formed with an extension removably connected to the pilot sub-assembly. Such an extension desirably includes several portions disposed with different angular orientations to provide a special angular orientation for the pilot burner of the pilot sub-assembly.

The pilot sub-assembly includes a specially designed mounting bracket providing substantially normal surfaces so that the first surface mounts the pilot burner and the second surface removably engages the outer portion of the unitary bracket extension while aligned openings within the second surface and the outer portion removably receive a securing element such as a stud, bolt or the like. A locking tab of the pilot sub-assembly mounting bracket is removably retained within an opening of the unitary extension member and cooperates with the locking stud to provide a secure but readily removable connection to properly position the pilot flame at a spaced position with respect to the gas distributing head.

The invention thus provides a highly desirable gas burner assembly which has been found particularly suitable for usage within a gas fired hot water heater and provides simplicity in construction while readily removable when repairs and/or replacements are required.

BRIEF DESCRIPTION OF THE DRAWINGS

The drawings furnished herewith illustrate the best mode presently contemplated by the inventor and clearly disclose the above advantages and features as well as others which will be readily understood from the detailed description thereof.

In the drawings.

DESCRIPTION OF THE PREFERRED ILLUSTRATED EMBODIMENT

Figure 1:
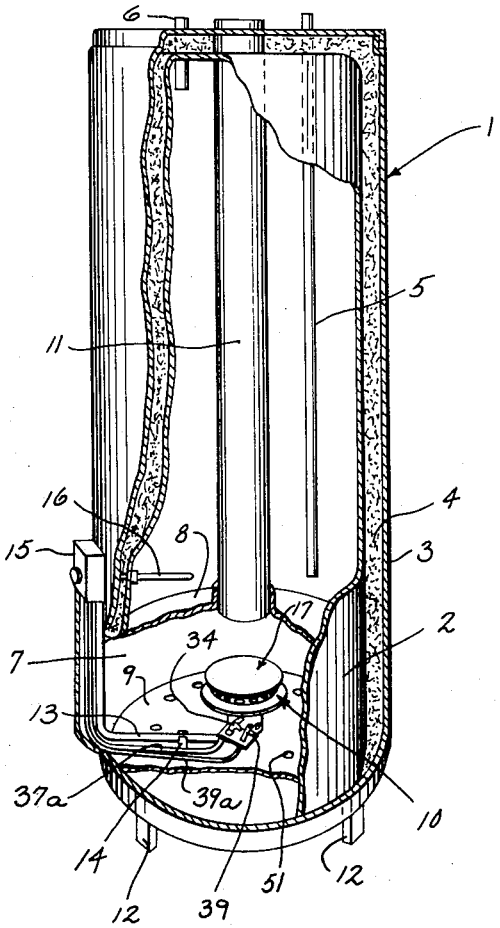
FIG. 1 is a perspective view of a hot water heater with parts broken away and incorporating the gas burner of the invention.
Figure 3:
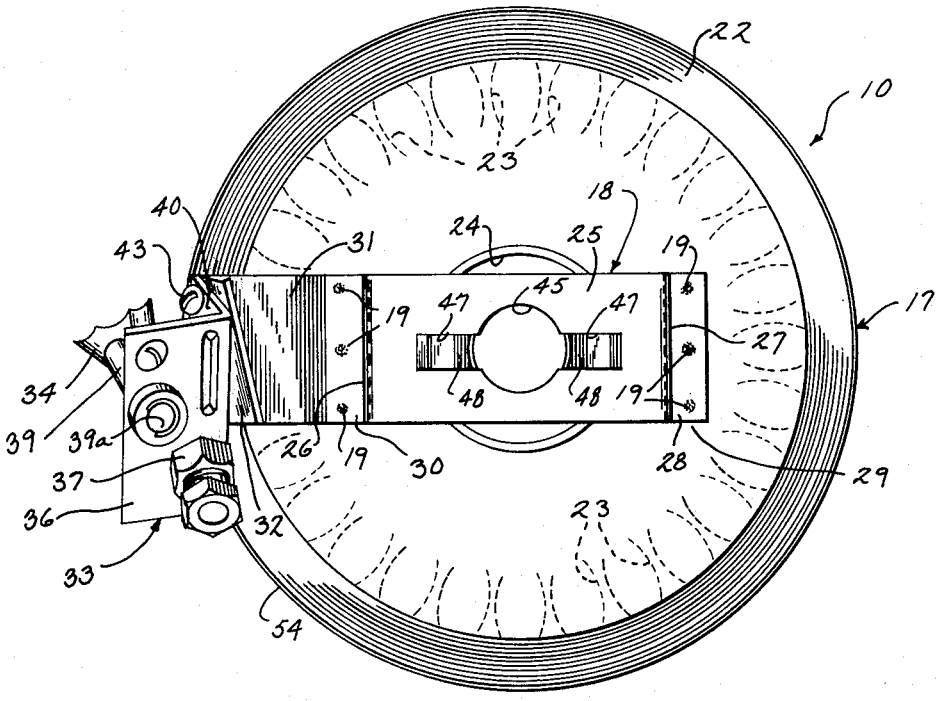
FIG. 3 is a bottom view of the gas burner of FIG. 2 with a portion of the pilot sub-assembly broken away.
Figure 6:
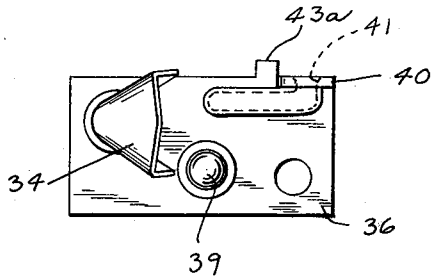
FIG. 6 is a plan view of the pilot sub-assembly of FIG. 5.
Figure 4:
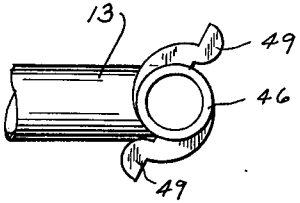
FIG. 4 is a plan view of the gas conducting tube of FIG. 2 with parts broken away.
Figure 5:
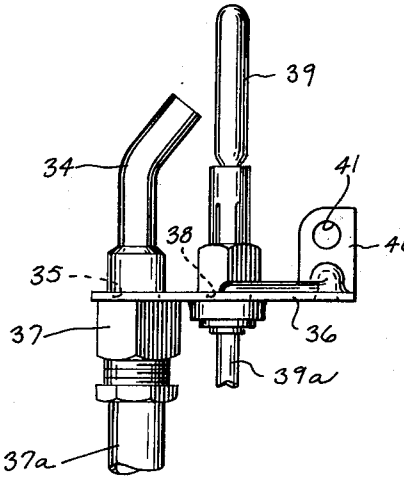
FIG. 5 is a side elevational view of the pilot subassembly of FIG. 2.
Figure 2:
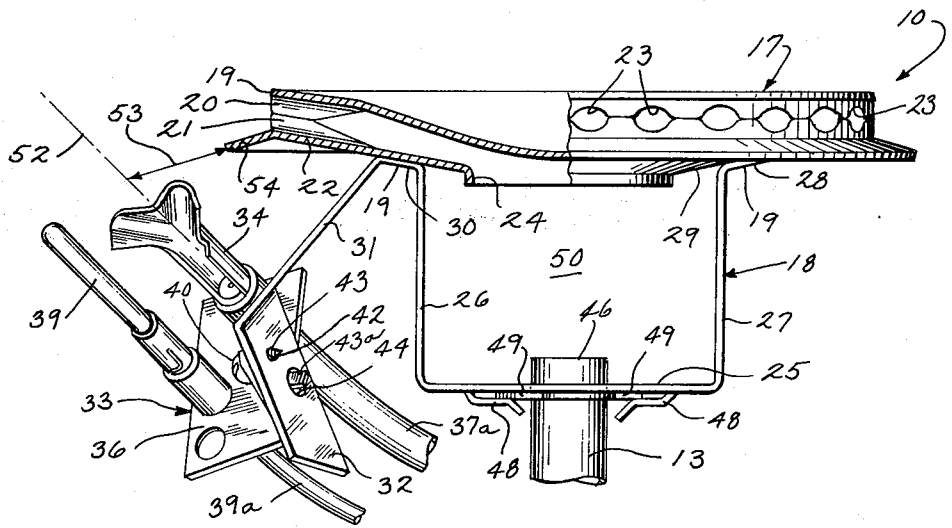
FIG. 2 is a side elevational view of the gas burner in FIG. 1 and shows a main burner sub-assembly, a pilot subassembly and a gas conducting tube.

The drawings illustrate a gas fired hot water heater 1 which includes a tank 2 containing water to be heated. The tank 2 is enclosed by an outer casing 3 and a layer of insulation 4, the latter spaced between the tank 2 and the casing 3.

Water is introduced into the tank 1 through a dip tube 5 while heated water is withdrawn from the tank 1 through a nipple 6 located in the upper portion of the tank.

A combustion chamber 7 is located in the lower portion of the water heater 1 and is defined by a lower head 8 of the tank 2 and a base 9 of the casing 3. A gas burner 10 is located within the combustion chamber 7 while the products of combustion are conducted upwardly through a flue 11 located centrally within the tank 2. The base 9 of the casing 3 is supported by a plurality of legs 12.

Gas is supplied to the burner 10 through a generally U-shaped tube 13 which is supported above the base 9 by a saddle 14. The outer end of the tube 13 is connected to a conventional gas shut-off valve mechanism 15 and interconnected thermostat 16, a portion of which is located on the outside of the casing 3. The conventional thermostat 16 is located within the bottom portion of the tank 2 and is operatively connected to open and close the gas valve and regulate the flow of gas to the burner in response to fluctuations in the water temperature.

The gas burner 10 includes a burner head 17 and a specially constructed bracket 18 integrally joined through a plurality of spot welds 19. The head 17 provides a distributor having a circumferentially shaped upper member 19 providing a plurality of circumferentially spaced radial projections 20 which engage a plurality of similarly constructed projections 21 located on a lower circumferentially shaped member 22. The plurality of circumferentially spaced abutting ridges or projections 20 and 21 provide a plurality of circumferentially spaced channels 23 formed therebetween which conduct air and gas from an annular opening 24 located centrally within the lower member 22 to the chamber 7 to be burned. The channels 23 thus terminate at the chamber 7 through a plurality of circumferentially spaced gas outlet ports.

The bracket 18 provides a U-shaped portion including a base portion 25 and a pair of oppositely spaced upwardly extending leg portions 26 and 27. An outer end portion 28 of leg 27 is bent at an angle and provides an abutting surface engaging a lower surface portion 29 of the distributor head 17 and secured thereto through the spot welds 19. The leg portion 26 is integrally joined to a portion 30 which provides an abutting surface secured to the surface 29 through the spot welds 19. The flange portion 30, in turn, is integral with an outwardly extending portion 31 providing an axis acutely orientated with respect to the axis of the flange portion 30 and spaced from the burner head 17. An outer end 32 is also integral with the flange portion 31 and provides an axis acutely orientated with respect to the axis of flange portion 31.

The flange portions 31 and 32 of the unitary bracket 18 are specially formed to removably secure a pilot sub-assembly 33. Specifically, the pilot sub-assembly 33 includes a gas operated pilot burner 34 mounted to pass through an opening 35 within a mounting bracket portion 36 and secured thereto by a locking nut 37. Gas is operatively supplied from the gas shut-off mechanism 15 to the pilot burner 34 through a tube 37*a*. The flange portion 36 also provides an opening 38 removably retaining a thermocouple unit 39 providing a control circuit 39*a* connected to the mechanism 15. A flange portion 40 is normally joined to the flange portion 36 and provides an opening 41 aligned with an opening 42 within flange portion 32 of bracket 18. A thread cutting screw is removably secured within openings 41 and 42 such as through engagement with internal threads therein. An outwardly projecting flange or tab 43*a* is integrally formed with the flange portion 36 and extends outwardly from the flange portion 40 and is removably retained within an opening 44 provided by the flange portion 32 of bracket 18.

The base portion 25 of bracket 18 includes a circumferential opening 45 which removably receives an outer end 46 of the U-shaped tube 13. A pair of oppositely disposed slots 47 are oppositely spaced in communication with the opening 45 with each slot 47 being adjacent to an associated tab 48 formed when punching out the slots 47.

The outer end 46 of the U-shaped tube 13 includes a pair of oppositely spaced and radially projecting tabs 49 which form a bayonet connection with the tabs 48. When assembling the burner head 17 to the U-shaped tube 13, the outer tube end 46 is passed through the circular opening 45. When the tabs 49 are located within the area between the projections 48 and the mounting portion 25, the head 17 is turned slightly to be removably supported by the tube 13 through the bayonet connection.

In operation, gas is supplied through the tube 13 and is discharged within an air-gas mixing area 50 located between the leg portions 26 and 27 and the mounting portion 25 and head 17. Air is supplied through a plurality of openings 51 within the base 9 and passes to the mixing area 50 through the open area between the spaced legs 26 and 27. The velocity of gas supplied by tube 13 to the mixing area 50 is sufficient to channel the air-gas mixture to the central opening 24 and thus through the plurality of channels or ports 23 to the combustion zone 7. A flame axis 52 provided by the pilot burner 34 is spaced by a predetermined distance indicated at 53 from an outwardly extending lip 54 provided by the head portion 22 and effectively ignites the air-gas mixture supplied through the output ports 23. The angular orientation of the pilot burner 34 directs the pilot flame to an area immediately adjacent the channel openings 23 but does not subject the distributor head 17 to the continuous supply of flame which might otherwise cause heat or flame damage.

The connection of the distributor head 17 and specially formed bracket 18 permits the entire burner assembly 10 including the removably connected pilot sub-assembly 33 to be readily removed through the bayonet-type connection provided by the tabs 48 and 49 from the U-shaped tube 13. The integrally formed portions 31 and 32 of the bracket 18 and the specially formed pilot bracket portions 36 and 40 provide a highly desirable compact construction and permits easy removal of the pilot sub-assembly 33 from the unitary connected distributor head 17 and bracket 18.

Various modes of carrying out the invention are contemplated as being within the scope of the following claims particularly pointing out and distinctly claiming the subject matter which is regarded as the invention.

I claim:

1. A gas burner assembly, comprising a tube operatively conducting gas, pilot means retaining a pilot burner operatively supplying a pilot flame along an axis, main burner means including a gas distributing head providing a gas inlet opening communicating with a gas outlet, mounting means connected to said distributing head and forming a unitary unit therewith and including a mounting portion spaced from said distributing head and defining an air-gas mixing area therebetween and a pair of spaced leg portions connecting said mounting portion to said distributing head with said air-gas mixing area located therebetween and communicating with said gas inlet opening, said unitary unit including an extending member retaining said pilot means and maintaining said pilot burner spaced adjacently to said gas outlet of said distributing head and spaced from said air-gas mixing area, said extending member comprising an extension of one of said legs, and means removably connecting said tube to said mounting portion to removably support said pilot and main burner means.

2. The gas burner assembly of claim 1, wherein said mounting means includes an opening removably retaining an outer end of said gas conducting tube.

3. A gas burner assembly, comprising a tube operatively conducting gas, pilot means including a pilot burner operatively supplying a pilot flame along an axis, main burner means including a gas distributing head providing a gas inlet opening communicating with a gas outlet and mounting means connected to said distributing head and forming a unitary unit therewith and including a mounting portion spaced from said distributing head and defining an air-gas mixing area therebetween communicating with said gas inlet opening, said main burner means including extension means connected to said unitary unit and to said pilot means and maintaining said pilot burner spaced adjacently to said gas outlet of said distributing head, said extension means including an outer end portion providing a mounting surface having first and second openings, said pilot means including a mounting bracket providing an abutting surface engaging said mounting surface and providing an opening aligned with said first opening, said mounting bracket including a tab removably retained within said second opening, and a locking stud removably located within said first opening and said mounting surface opening and securing said pilot means to said main burner means, and means removably connecting said tube to said mounting portion to removably support said pilot and main burner means.

4. The gas burner assembly of claim 3, wherein said pilot mounting bracket also retains a thermocouple spaced from said pilot burner.

5. A gas burner assembly, comprising a tube operatively conducting gas, pilot means including a pilot burner operatively supplying a pilot flame along an axis, main burner means including a gas distributing head providing a gas inlet opening communicating with a gas outlet, a unitary bracket having a first bracket portion connected to said distributing head and a second bracket portion connected to said pilot means and maintaining said pilot burner spaced adjacent to said gas outlet of said distributing head, said unitary bracket including a mounting portion spaced from said first bracket portion, and means removably connecting said tube to said unitary bracket mounting portion and removably supporting said pilot and main burner means, said mounting portion spacing said tube from the gas inlet opening to define an air-gas mixing area therebetween

6. A gas burner assembly comprising a burner sub-assembly including a gas distributing head having an annular portion providing a centrally located gas inlet opening and a circular rim radially spaced from said inlet opening and providing a peripheral edge extending downwardly at an angle to the horizontal and a plurality of circumferentially spaced first projections located between said inlet opening and said rim, said distributing head including a generally circular cover portion having a plurality of circumferentially spaced second projections connected to said first projections and forming a plurality of circumferentially spaced gas conducting channels defining gas outlet ports, said sub-assembly including a mounting flange having a base portion spaced from said distributing head and providing a circular opening communicating with a pair of oppositely disposed slots formed adjacent to a pair of associated tabs extending downwardly at an angle to the horizontal and a pair of spaced leg portions extending from said base portion to said distributing head for defining an air-gas mixing area and each leg providing an outer end portion spot welded to said annular portion, said mounting flange including a receiving portion providing first and second openings and extending upwardly at a first angle to the horizontal and connected to said outer end portion of one of said leg portions through a connecting portion extending upwardly at a second angle to the horizontal different than said first angle, a pilot sub-assembly including a mounting bracket having a first portion retaining a pilot burner operatively supplying a pilot flame along an axis substantially normal to said first portion and spaced from said gas distributing head and a second portion substantially normal to said first portion and engaging said receiving portion and providing a stud receiving opening aligned with said first opening of said receiving portion, said first portion of said mounting bracket including a tab removably located with said second opening of said receiving portion, said stud receiving opening and said first opening removably receiving a locking stud, and a gas conducting tube providing an outer end including a pair of oppositely spaced projections removably retained by said tabs provided by said base portion and forming a bayonet-type connection and operatively supplying gas to said air-gas mixing area and to said gas outlet ports for ignition by said pilot flame.

* * * * *